US005913478A

United States Patent [19]

Ochsman

[11] Patent Number: 5,913,478

[45] Date of Patent: Jun. 22, 1999

[54] WEARABLE CLAMP FOR RELEASEABLY HOLDING A NAPKIN OR OTHER FLEXIBLE SUBSTRATE AND METHOD FOR WEARING A NAPKIN OR OTHER FLEXIBLE SUBSTRATE

[75] Inventor: Ralph Ochsman, Potamac, Md.

[73] Assignee: Drip Clip, Inc., Potomac, Md.

[21] Appl. No.: 09/049,563

[22] Filed: Mar. 27, 1998

[51] Int. Cl.[6] ..... A45F 5/00

[52] U.S. Cl. ..... 24/7; 24/8; 24/66.11; 24/541

[58] Field of Search ..... 24/7, 8, 9, 3.1, 24/114.9, 65, 66.2, 66.8, 66.11, 516, 541

[56] References Cited

U.S. PATENT DOCUMENTS

| | | | |
|---|---|---|---|
| 184,376 | 11/1876 | Hardy et al. | 24/8 |
| 187,649 | 2/1877 | Lewis et al. . | |
| 202,202 | 4/1878 | Thompson . | |
| 264,879 | 9/1882 | Hugill . | |
| 501,332 | 7/1893 | Drevet . | |
| 514,454 | 2/1894 | Feiner et al. | 24/541 |
| 655,069 | 7/1900 | Frame . | |
| 765,784 | 7/1904 | McClay | 24/8 |
| 823,704 | 6/1906 | Simpson | 24/8 |
| 889,969 | 6/1908 | Rossuck | 24/541 |
| 921,663 | 5/1909 | Bateman | 24/66.11 |
| 929,016 | 7/1909 | Rensch | 24/516 |
| 1,390,083 | 9/1921 | Bowen | 24/7 |
| 1,692,712 | 11/1928 | Tannebaum | 24/516 |
| 1,864,281 | 6/1932 | Short . | |
| 2,165,216 | 7/1939 | Boots | 24/66.8 |
| 2,247,372 | 7/1941 | Hart . | |
| 2,287,717 | 6/1942 | Barnes . | |
| 3,439,439 | 4/1969 | Stimson | 24/114.9 |

FOREIGN PATENT DOCUMENTS

| | | | |
|---|---|---|---|
| 14695 | 10/1881 | Germany . | |
| 0019524 | of 1900 | United Kingdom | 24/8 |

OTHER PUBLICATIONS

Unknown Catalog p. 87, received Apr. 24, 1998, one page.

*Primary Examiner*—Victor N. Sakran

[57] ABSTRACT

A wearable napkin holding clamp includes a substantially planar base hingedly connected to a movable jaw and carries an L-shaped lever and a spring clip. The base, movable jaw and L-shaped lever together bear a loose resemblance to a clamp for use with suspenders (e.g., for attachment to the waist band of the pants). The base includes a base jaw, a base central aperture and has first and second opposing perpendicular journal tabs, each with a coaxial journal hole therethrough. The base also preferably includes first and second elongate raised salient features which are disposed substantially parallel to the base sidewalls and to one another and are spaced apart by a selected spacing defining a groove or trough therebetween. The movable jaw also includes teeth, spring center tabs received in the base central aperture, and first and second oppositely projecting side tabs disposed between the upwardly projecting base wall and base journals to provide a spring biasing force (in cooperation with a biasing force provided by the center tabs) tending to force the movable jaw into an open position. The L-shaped lever includes a substantially planar front cover attached at one end to a substantially perpendicular camming lever arm having, on opposite sides, first and second axial tabs sized to be received in the coaxially aligned opposing base journal tab holes. The spring clip is preferably fabricated from spring steel wire or the like and includes a number of compound curves and bends forming an elongate narrow clip arm terminating in a clip arm distal end. The spring clip also includes first and second yoke members exerting a spring force, biasing the clip arm into close proximity with the back surface of the base; the clip arm is thereby disposed intermediate the first and second base elongate salient features.

16 Claims, 4 Drawing Sheets

USA

WEARABLE CLAMP FOR RELEASEABLY HOLDING A NAPKIN OR OTHER FLEXIBLE SUBSTRATE AND METHOD FOR WEARING A NAPKIN OR OTHER FLEXIBLE SUBSTRATE

BACKGROUND OF THE INVENTION

1. Field of the Invention

The present invention relates to clothing accessories, and more particularly, wearable accessories for supporting a napkin or the like in position to provide a protective cover over the clothes, for use while dining.

2. Discussion of the Prior Art

Diners have soiled and stained shirts, ties, blouses and dresses while dining. Both children and adults are sometimes prone to spilling sauces or soups and dropping morsels of food onto their clothing, possibly ruining a favorite garment.

As a result, children are often forced to wear bibs covering part or all of the front torso, and may struggle to avoid having a bib tied around the neck. Gentlemen and ladies may sometimes stoop to wearing a bib, especially at bar-b-ques, crab feasts or the like, but never when engaged in fine dining in a restaurant. Aside from connotations of childishness, bibs are unacceptable to most diners because they are often just gauche sheets of plastic tied about the neck, are uncomfortable against the throat, and seldom compliment one's wardrobe. As a result, most diners will not wear a bib when dining out and so may be forced to forgo a much-desired but possibly messy lobster dinner, to cite but one example.

Children will sometimes take a napkin from the table and stuff or tuck a portion of the napkin down behind a tightly buttoned collar. While expedient, this solution is also not acceptable for a fine dining experience and is not likely to garner favor among gentle people in a diner's company. Both of the above mentioned activities (i.e., wearing a bib and stuffing a napkin in one's shirt collar) seem to suggest to the onlooker that the diner's appearance does not matter and that the diner is about to throw caution to the wind, engaging in a bacchanalian orgy of eating and drinking, with food and drink likely flying about. A diner who merely wishes to keep his or her clothes unstained surely has no desire to convey such an impression.

In the prior art, others have attempted to meet this unresolved need by providing napkin holders for carrying a napkin worn on the diner's front and hung from a button. The various prior art napkin holders have failed to gain widespread acceptance, however, because of difficulty in use, unsightly appearance, strain placed on buttons, the requirement that the wearer have a shirt or blouse with buttons, and other shortcomings.

There has been a long felt need, then for a wearable napkin holder permitting a diner to easily and effectively protect his or her clothing while maintaining an attractive appearance, thereby providing the diner with a comfortable sense of propriety.

OBJECTS AND SUMMARY OF THE INVENTION

It is an object of the present invention to overcome the shortcomings of the prior art.

Another object is providing a wearable, stylish apparatus for attaching or draping a napkin to cover a diner's front torso area.

Yet another object is providing convenience and flexibility in how and where a user hangs, suspends or attaches a napkin holding device onto the users front, for covering the clothes, or the like.

The aforesaid objects are achieved individually and in combination, and it is not intended that the present invention be construed as requiring two or more of the objects to be combined unless expressly required by the claims attached hereto.

In accordance with the present invention, a wearable napkin holding clamp includes a substantially planar base hingedly connected to a movable jaw and carries an L-shaped lever and a spring clip. The base, movable jaw and L-shaped lever together bear a loose resemblance to a clamp for use with suspenders (e.g., for attachment to the waist band of the pants). The base includes a base jaw with jaw teeth or serrations on a first end opposing a second end having a perpendicular base wall. The base also includes a base central aperture proximate the base wall and has first and second opposing perpendicular journal tabs, each with a journal hole therethrough. The base also preferably includes first and second elongate raised salient features which are disposed substantially parallel to the base sidewalls and to one another and are spaced apart by a selected spacing defining a groove or trough therebetween.

The movable jaw also includes teeth or serrations adapted to cooperatively close to a closed position proximate to (but slightly offset from) the base jaw teeth. The movable jaw also includes spring center tabs which are received in the base central aperture. The Movable jaw also includes first and second oppositely projecting side tabs which are disposed between the upwardly projecting base wall and base journals to provide a spring biasing force (in cooperation with a biasing force provided by the center tabs) tending to force the movable jaw into an open position. The movable jaw also includes a camming surface disposed substantially between the base projecting journal tabs.

The L-shaped lever includes a substantially planar front cover attached at one end to a substantially perpendicular camming lever arm having, on opposite sides, first and second axial tabs sized to be received in the coaxially aligned opposing base journal tab holes. The lever planar front cover has an outer surface optionally bearing an ornamental design, the design is preferably stamped or molded into the planar front cover and can be seen on the front cover inner surface (opposite the outer surface).

The spring clip is preferably fabricated from spring steel wire or the like and includes a number of compound curves and bends forming an elongate narrow clip arm terminating in a clip arm distal end. The spring clip also includes first and second yoke members bent back at an acute angle and formed in a shallow arcuate curve; the distal ends are received in a notch between the base wall the base journal tabs. The spring clip yoke members exert a spring force tending to bias the clip yoke distal ends against the inner surfaces of the first and second base projecting journals and provide an orienting force for the spring clip, biasing the clip arm into close proximity with the back surface of the base; the clip arm is thereby disposed intermediate the first and second base elongate salient features. Preferably, as noted above, the base salient features provide a trough or a groove therebetween into which the clip arm rests, thereby providing additional friction on a napkin or substrate (e.g., fabric, webbing or the like) which is interposed between the clip arm and the base back surface.

The napkin holding clamp may be opened by grasping the base and rotating the lever about the axis of the journal tab holes, thereby allowing the spring force biasing the movable jaw to force the movable jaw and the base apart. To close the clamp, one grasps the planar front cover and rotates it about the axis of the journal holes, toward the base jaw, so the camming lever arm is brought downwardly to bear on the movable jaw camming surface, thereby forcing the movable jaw teeth into close proximity with the base jaw teeth. Once the planar front cover is in the fully closed position, the spring bias force of the movable jaw tends to push upwardly against the camming lever arm, thereby keeping napkin holding clamp 10 biased in the closed position.

When the diner or user wishes to use the napkin holding clamp, the user finds a suitable button hole and, while grasping the napkin holding clamp by either the base or front cover, the clip arm distal end is maneuvered through the open button hole and the napkin holding clamp is then further inserted such that the selected button hole is slidably brought into close proximity with the hilt of the clip arm (at the first and second sliding clip yoke members).

The spring clip yoke members are bent to leave a gap or spacing (e.g., two millimeters (mm)) therebetween; the gap defines the spacing between the wire segments making up the clip arm. The clip arm width is selected to permit the clip arm to lie in-line with the long axis of the button hole, without straining or tearing the button hole stitching. The gap between first and second yoke members (e.g., two mm) is also sufficiently wide to allow a standard shirt button (having a thickness of two mm) to pass therethrough, allowing the user to replace the shirt button in the button hole after the napkin holding clamp has been inserted into and suspended from the button hole.

Once the napkin holding clamp has been suspended from or is supported by the button hole, the user may then grasp the planar front cover, opening the jaws, whereupon a napkin or other protective cloth or cover may be inserted between the jaws. The user then simply grasps the planar front cover and closes the jaws as discussed above, thereby firmly clamping and grasping the napkin.

For users having no suitably located button holes such as those wearing crew-neck sweaters or the like, the user may simply grasp the napkin holding clamp by the planar front cover or base and insert the collar fabric in between the clip arm distal end and the base, advancing the collar fabric toward the clip arm hilt at the first and second yoke members, thereby securely suspending the napkin holding clamp from the collar.

Users wishing to protect a neck-tie can suspend the napkin holding clamp by the clip arm. The clip arm distal end is inserted in the upward facing horizontal seam as found on a neck tie tied in the Windsor style. The napkin holding clamp is then slidably moved downwardly to permit the clip arm hilt to rest upon the horizontal segment of the neck tie, at the top and center of the Windsor knot (to cite but a single example).

The base, movable jaw, L-shaped lever, and spring clip may be made from carbon steel, stainless steel, aluminum, gold, silver, platinum , plastic, or any combination thereof, as the intended market and use dictate. The napkin holding clamp can be given to diners as promotional items bearing an advertising logo or may be made of a precious metal for sale in fine jewelry stores. The napkin holding clamp can also be packaged for presentation with a napkin or scarf, optionally including indicia matching indicia on the clamp front cover (e.g., for school colors or the like).

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components.

DESCRIPTION OF THE PREFERRED EMBODIMENT

Figures 1, 2, 3, 4:
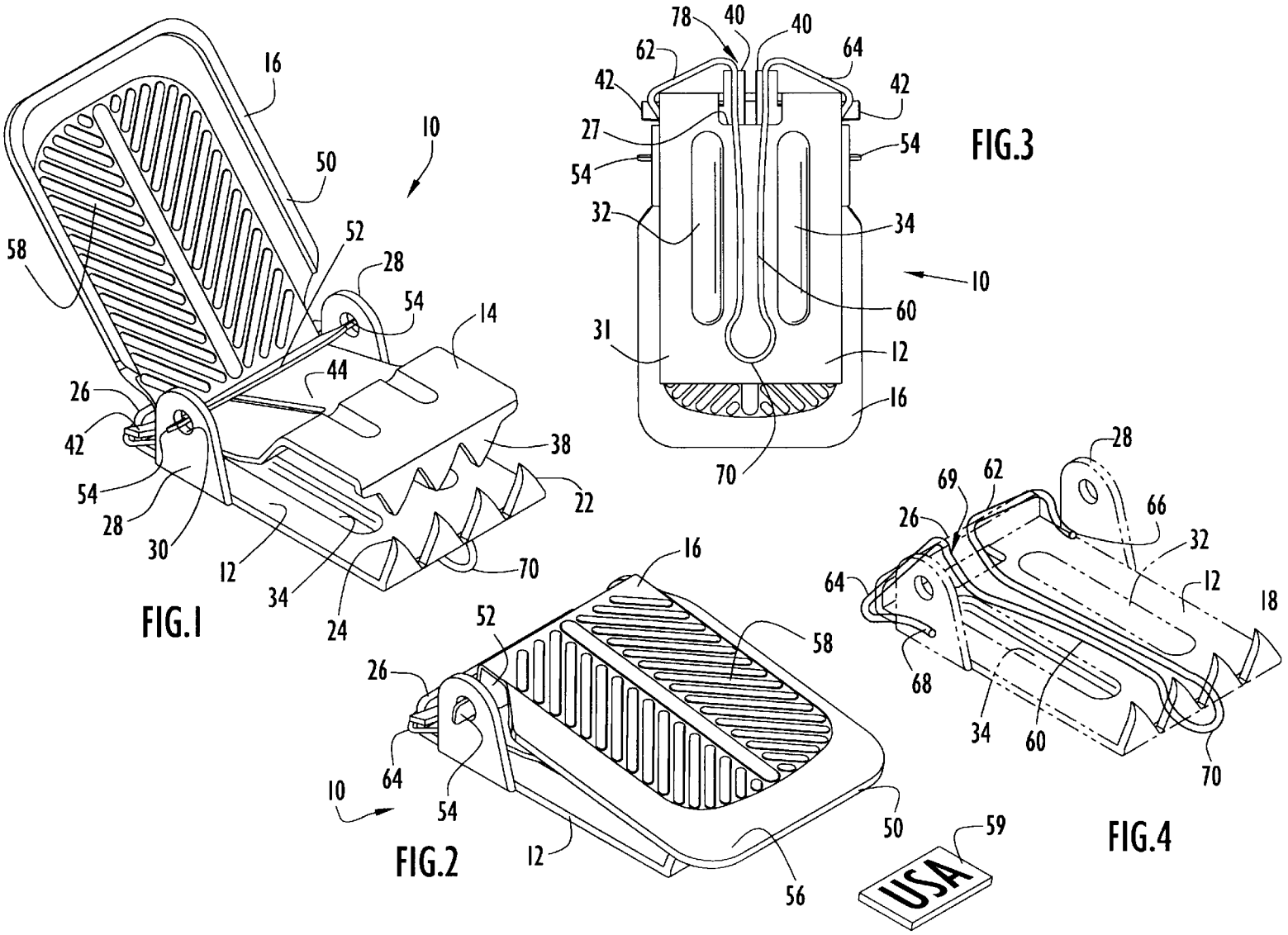
FIG. 1 is a perspective view of a napkin holding clamp in the open position.
FIG. 2 is a perspective view of the napkin holding clamp of FIG. 1, in the closed position.
FIG. 3 is a rear view, in elevation, of the napkin holding clamp of FIG. 2.
FIG. 4 is a perspective view of the napkin holding clamp spring clip shown with a phantom representation of the napkin holding clamp base.

Referring specifically to FIGS. 1, 2, 3 and 4 of the accompanying drawings, a wearable clamp 10 is illustrated in the open position; clamp 10 is well suited to grasp and hold a napkin (or other flexible substrate) and so will, for purposes of nomenclature, be identified as a napkin holding clamp. Napkin holding clamp 10 includes a substantially planar base 12 hingedly connected to a movable jaw 14 and carrying an actuator or L-shaped lever 16 and a spring clip 18. Base 12 includes a base jaw 22 having a plurality of jaw teeth or serrations 24 opposing (along the long dimension of base 12) a perpendicular base wall 26 (best seen in the phantom view of FIG. 4). Base 12 includes a base central aperture 27 proximate base wall 26 and has first and second opposing base projecting journals 28 which are preferably formed as perpendicular tabs, each including a journal hole 30. Viewed from the back side 31 or rear, as shown in FIG. 3, Base 12 also preferably includes first and second elongate salients 32, 34 which are disposed substantially parallel to the base sidewalls and to one another and are spaced apart by a selected spacing, defining a trough, recess or groove therebetween.

Movable jaw 14 also includes teeth or serrations 38 adapted to cooperatively close in an offset shearing motion into close proximity with base jaw teeth 24. Movable jaw 14 also includes bendable, spring-like center tabs 40 which are adapted to be received in base central aperture 27. Movable jaw 14 also includes first and second side tabs 42 which are disposed in a notch defined between the upwardly projecting base wall 26 and base projecting journals 28 to provide a spring biasing force (in cooperation with a biasing force provided by the center tabs 40) tending to force movable jaw 14 into the opened position (as shown in FIG. 1). Movable jaw 14 also includes a camming surface 44 disposed substantially between the base projecting journals 28.

L-shaped lever 16 includes a substantially planar front cover 50 attached at one end to a substantially perpendicular camming lever arm 52 having, on opposite sides, first and second axial tabs 54 which are sized appropriately to be received in the coaxially aligned base projecting holes 30, as shown in FIGS. 1 and 2, thereby defining a hinge having an axis of rotation. The lever planar front cover 50 has an outer surface Be 56 (as shown in FIG. 2) bearing an ornamental design 58 which is preferably stamped or molded into planar front cover 50 and so the design can be seen on the front cover inner surface opposing outer surface 56 (as shown in FIG. 1). Optionally, a placard 59 may be bonded onto outer surface 56 for display of any selected symbols, indicia or logo (e.g., "USA", as shown in FIG. 2).

Spring clip 18 is preferably fabricated from a contiguous length of spring steel wire or the like and includes a number of compound curves and bends, as shown in FIG. 4, forming an elongate narrow clip arm 60 terminating in a clip arm free distal end 70. Spring clip 18 also includes a first yoke member 62 symmetrically opposing a second yoke member 64 where first yoke member is terminated in a first yoke member distal end 66 and second yoke member 64 is terminated in a second yoke member distal end 68. The yoke members of spring clip 18 are bent back at an acute angle leaving a gap 69 therebetween and then are formed in a shallow arcuate curve and are thereby adapted to be received in the notch or groove between base wall 26 and the base projecting journals 28, as shown (in phantom) in FIG. 4. Spring clip yoke members 62 and 64 thereby exert a spring force tending to bias the distal ends against the inner surfaces of the first and second base projecting journals 28 and provide an orientation for spring clip 18 tending to bias clip arm 60 into close proximity with the surface of base 12, intermediate the first and second base elongate salients 32, 34. Preferably, the base salients 32 and 34 provide a trough or a groove therebetween into which clip arm 60 rests, thereby providing additional friction on any fabric, webbing or the like which is interposed between clip arm 60 and base 12.

The napkin holding clamp 10 may be opened by grasping base 12 and rotating lever 16 about the axis of journal holes 30, thereby allowing the spring force biasing movable jaw 14 into the open position to force the movable jaw and the base apart, as shown in FIG. 1. By grasping planar front cover 50 and rotating it about the axis of holes 30 toward base jaw 22, camming lever arm 52 is brought downwardly to bear on movable jaw camming surface 44, thereby forcing movable jaw teeth 38 into close proximity of base jaw 22. As shown in FIG. 2, once the planar front cover is in the fully closed position camming lever arm 52 is past perpendicular with respect to camming surface 44 and the spring bias force of movable jaw 14 tends to push upwardly against the (now) angled camming lever arm 52, thereby keeping napkin holding clamp 10 biased in the closed position.

Base 12, movable jaw 14, L-shaped lever 16, and spring clip 18 are preferably made from carbon steel, stainless steel, aluminum, gold, silver, platinum, plastic, or any combination thereof, as the intended market and use dictate. Napkin holding clamp 10 can be offered to diners as a promotional item bearing an advertising logo or may be made of a precious metal for sale in fine jewelry stores. The napkin holding clamp 10 can also be packaged for presentation with a napkin 80 or scarf, optionally including indicia matching the indicia on placard 59 bonded to clamp front cover 50 (e.g., for school colors or the like).

Figure 6:
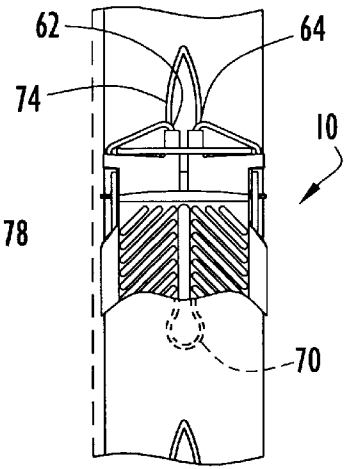
FIG. 6 shows, in elevation, the napkin holding clamp of the present invention suspended from a button hole.
Figure 5:
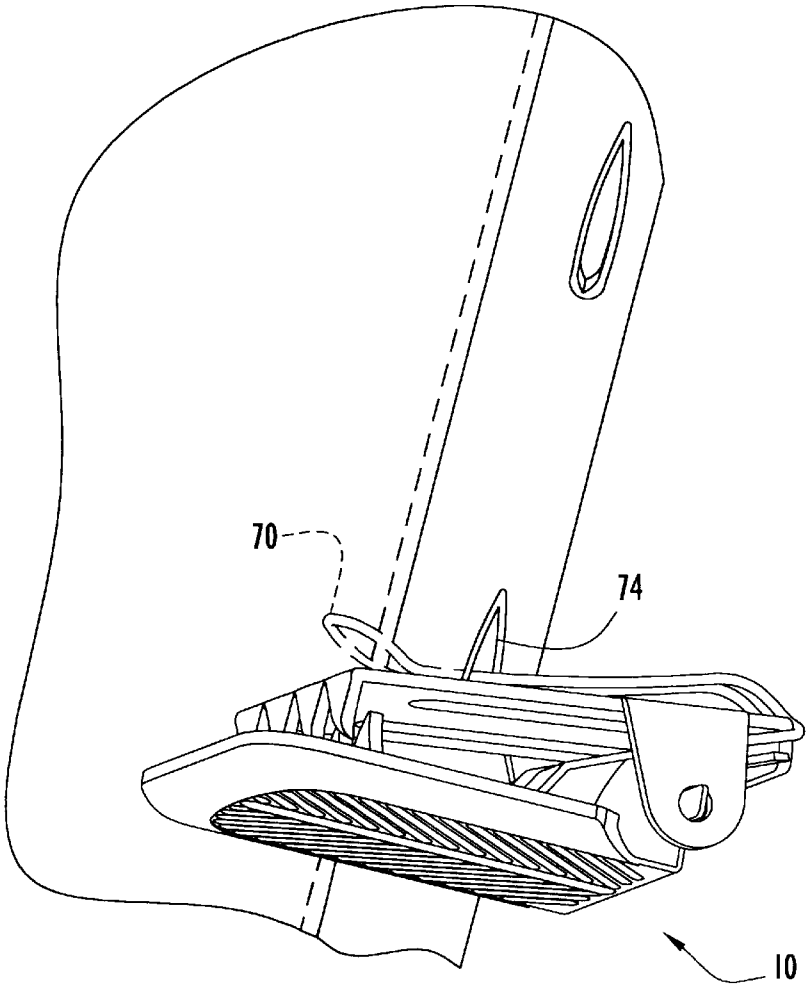
FIG. 5 is a perspective illustration of use of the napkin holding clamp of FIG. 1 and shows the method step of inserting the clip arm distal end through a button hole.
Figure 8:
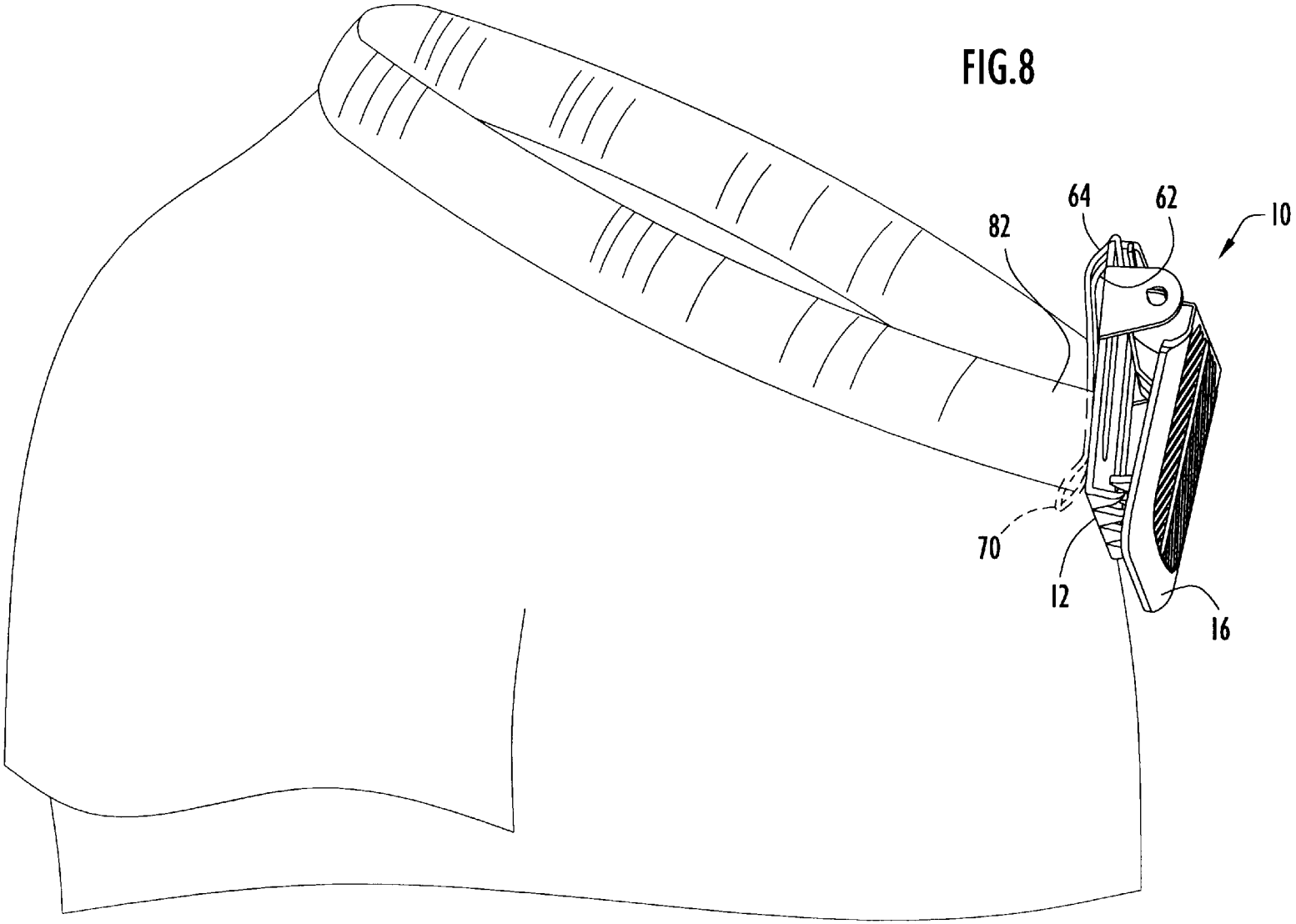
FIG. 8 illustrates, in perspective, the napkin holding clamp inserted over a crewneck collar.

When the user desires to use napkin holding clamp 10, a suitably located button hole (such as 74, shown in FIG. 5) is found and, while grasping the napkin holding clamp 10 by either base 12 or front cover 50, the clip arm distal end 70 is maneuvered through the open button hole 74. The napkin holding clamp 10 is then translated or further inserted such that the selected button hole 74 is slidably brought to the hilt of the clip arm 60, into close proximity with first and second sliding clip yoke members 62, 64, as shown in FIG. 6.

Figure 7:
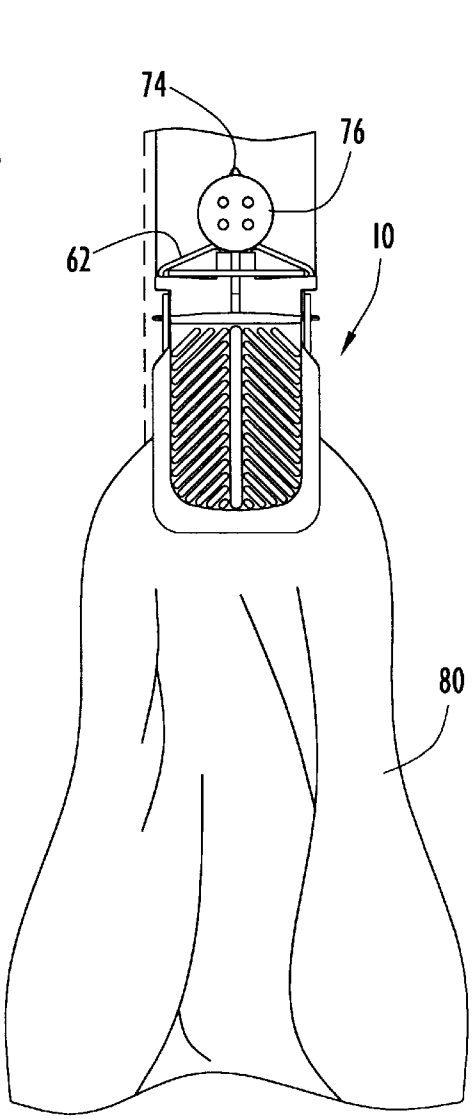
FIG. 7 illustrates the napkin holding clamp of FIG. 6 suspended in the button hole and supporting a napkin.

As noted above, yoke members 62 and 64 are bent to form clip arm 60 leaving a small gap (e.g., two mm) sized sufficiently small to allow clip arm 60 to lie in-line with the long axis of button hole 74. The gap between first and second yoke members 62, 64 (e.g., two mm) is also sufficiently wide to allow a standard shirt button having a thickness of two mm (e.g., button 76 as shown in FIG. 7) to pass therethrough allowing the user to replace button 76 in button hole 74 after napkin holding clamp 10 has been inserted into and suspended from button hole 74.

Once napkin holding clamp 10 has been suspended from or is supported by button hole 74, the user may then grasp a planar front cover 50 thereby opening jaws 14, 22 whereupon a napkin 80 or other protective cloth, substrate or cover may be inserted between the jaws. The user then simply grasps planar front cover 50 and closes jaws 14, 22 as discussed above, thereby firmly clamping and grasping napkin 80.

For users wearing garments having turtleneck, cowl-neck or crew-neck collars such as sweaters, T-shirts, sweatshirts or the like, the user may simply grasp napkin holding clamp 10 by planar front cover 50 or base 12 and insert the collar top edge 82 in between the clip arm distal end 70 and base 12, advancing the collar top edge 82 toward the clip arm hilt 78 or apex defined by first and second yoke members 62, 64 thereby securely suspending napkin holding clamp 10 from the collar.

Figure 9:
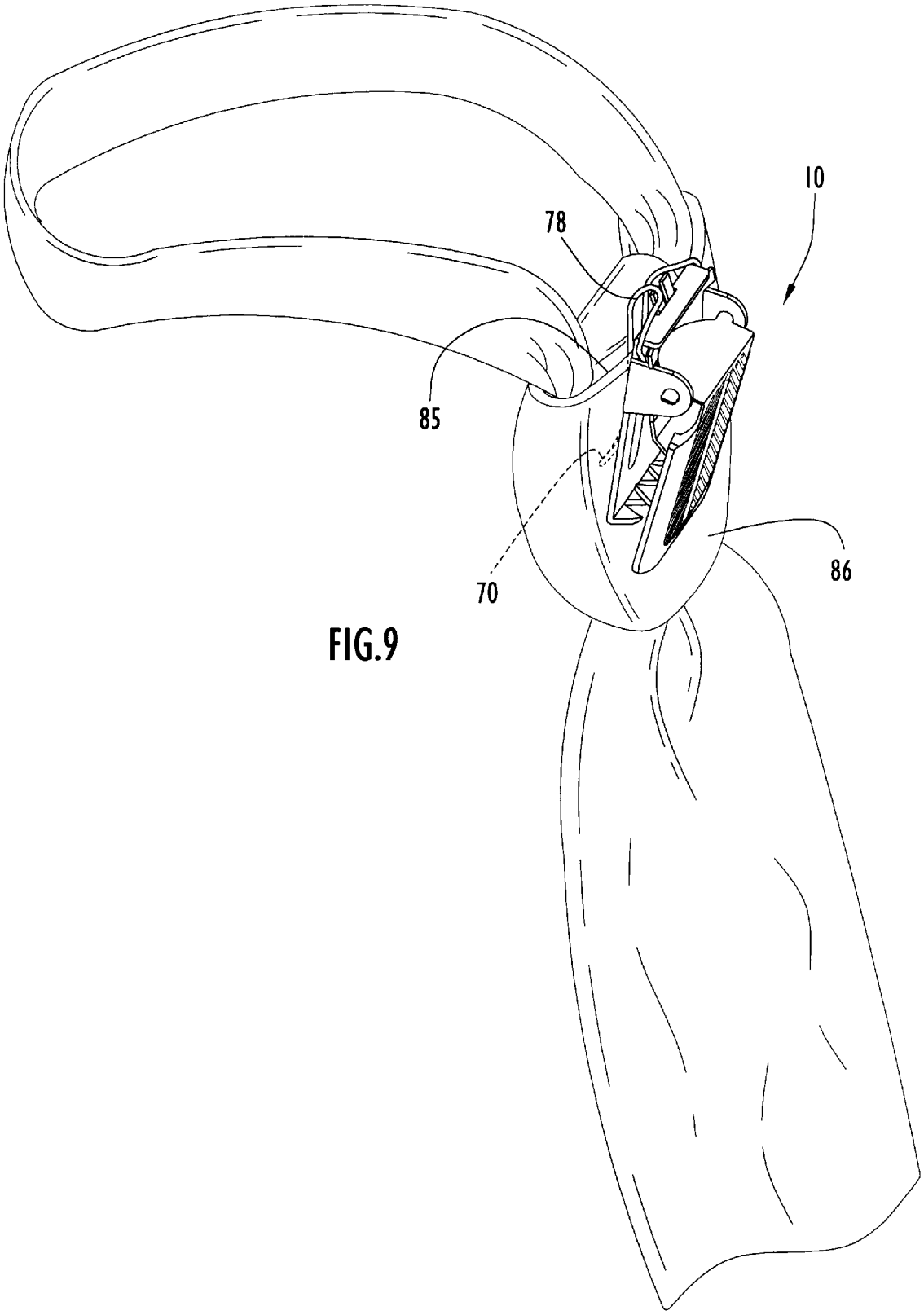
FIG. 9 is a perspective illustration of the napkin holding clamp of the present invention suspended from a neck tie knot.

As shown in FIG. 9, users wishing to protect a neck-tie can suspend the napkin holding clamp 10 by the clip arm 60. The clip arm distal end 70 is inserted in the upward facing horizontal seam 85 as found on a neck tie tied in the Windsor style. The napkin holding clamp 10 is then slidably moved downwardly to permit the clip arm hilt 78 to rest upon the horizontal segment 86 of the neck tie, at the top and center of the Windsor knot (to cite but a single example).

The collar or tie fabric (or the fabric proximate button hole 74) is preferably securely grasped by the spring tension of clip arm 60 which preferably bears light, steady pressure against base 12, between first and second elongate salients 32, 34. The fabric thus secured by clip arm 60 bears against the inner surfaces of salients 32, 34 and against the substantially planar surface of base 12 therebetween; friction force is also provided by the surface of clip arm 60. The surfaces of salients 32, 34, the trough or planar area of the base therebetween and the inward facing surface of clip arm 60 may all textured or serrated to further enhance the grasping and holding power of the spring clip 18 on the fabric so engaged. Alternatively, the resilient clip arm may be aligned substantially parallel to base back side 31 but not contact the back side, leaving a space between the clip arm 60 and the back side 31 proximate the clip arm distal end 70.

The napkin holding clamp 10 as shown in FIGS. 1, 2, 3 and 4 are drawn substantially to scale. Base 12 is approximately thirty mm along the long dimension and is approximately nineteen mm across the transverse, shorter width dimension; each of the elongate salient features 32, 34 is approximately seventeen mm in length. The planar front cover 50 of lever or actuator 16 is approximately twenty-eight mm along the long dimension and at its widest, is approximately twenty-two mm across the transverse, shorter width dimension. Clip arm 60 has a length measured from hilt 78 to distal end 70 of approximately thirty mm, and a transverse width, proximate the hilt 78 of approximately three mm; the clip arm width is compared to the relaxed width of a button hole (e.g., 74, once used) of approximately two to three mm; thus in the width dimension, a clip arm is unlikely to strain or tear open a button hole.

Alternatively, the clip arm can be integrally molded into and carried by the base 12 extending along substantially the entirety of the long dimension of and preferably bisecting base back side 31, between and parallel to elongated salient features 32, 34.

In as much as the present invention is subject to various modifications and changes in detail, the above description of a preferred embodiment is intended to be exemplary only and not limiting. It is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A clamp for grasping and holding a napkin or other flexible substrate, comprising:

a base having a back side, salient means for frictionally engaging the substrate and a first jaw;

a second jaw, substantially opposable to said first jaw;

an actuator bearing upon said second jaw and supported by said base; and a spring clip having a clip arm resiliently biased toward said base back side.

2. The clamp of claim 1, wherein said second jaw is biased apart from said first jaw.

3. The clamp of claim 1, wherein said spring clip comprises a contiguous length of wire forming a resiliently biased clip arm.

4. The clamp of claim 1, wherein said base salient means includes at least one salient feature.

5. The clamp of claim 4, wherein said clip arm is biased into a position proximate said salient feature.

6. The clamp of claim 1, further including a front cover bearing a design, logo or indicia.

7. The clamp of claim 6, further including a napkin or scarf bearing indicia matching the indicia on said front cover.

8. A clamp for grasping and holding a napkin or other flexible substrate, comprising:

a base having a back side, salient means for frictionally engaging the substrate, first and second projecting aligned hinge means, and a first jaw;

a second jaw, substantially opposable to and biased apart from said first jaw;

a lever including a front cover, axial members received in said base hinge means, and a lever arm oriented to bear against said second jaw; and a spring clip having a clip arm resiliently biased toward said base back side.

9. The clamp of claim 8, wherein said base back side includes at least one salient feature.

10. The clamp of claim 9, wherein said clip arm is biased into a position proximate said salient feature.

11. The clamp of claim 8, further including a front cover bearing a design, logo or indicia.

12. The clamp of claim 11, further including a napkin or scarf bearing indicia matching the indicia on said front cover.

13. A method for wearing a napkin or other flexible substrate, comprising the method steps of:

a) providing a wearable clamp including a base having a back side and a first jaw, a second jaw, substantially opposable to and biased apart from said first jaw, and a spring clip having a clip arm having a length substantially coextensive with said base back side, said clip arm having a free distal end opposite a clip arm hilt;

b) grasping a garment to expose a button hole;

c) inserting said clip arm free distal end into said button hole;

d) moving said clamp clip arm through said button hole and up to the clip arm hilt;

e) suspending the napkin over the wearer's front by inserting the napkin between the clamp jaws, and f) closing the clamp jaws, thereby holding the napkin with the clamp.

14. The method of claim 13, wherein method step d includes:

d1) moving said clamp clip arm through said button hole and up to the clip arm hilt; and d2) aligning said clamp to hang from said button hole so that the major axis of the button hole is substantially co-linear and aligned with said clip arm length.

15. A method for wearing a napkin or other flexible substrate, comprising the method steps of:

a) providing a wearable clamp including a base having a back side and a first jaw, a second jaw, substantially opposable to and biased apart from said first jaw, and a spring clip having a clip arm resiliently biased toward said base back side, said clip arm having a free distal end opposite a clip arm hilt;

b) grasping a garment collar top edge;

c) inserting said collar top edge between said clip arm free distal end and said clamp base back surface;

d) moving said collar top edge along the length of said clamp clip arm and up to the clip arm hilt;

e) suspending the napkin over the wearer's front by inserting the napkin between the clamp jaws, and f) closing the clamp jaws, thereby holding the napkin with the clamp.

16. A method for wearing a napkin or other flexible substrate, comprising the method steps of:

a) providing a wearable clamp including a base having a back side and a first jaw, a second jaw, substantially opposable to and biased apart from said first jaw, and a spring clip having a clip arm having a length substantially coextensive with said base back side, said clip arm having a free distal end opposite a clip arm hilt;

b) grasping a neck tie segment top edge;

c) inserting said neck tie segment top edge between said clip arm free distal end and said clamp base back surface;

d) moving said clamp clip arm downwardly past the neck tie segment top edge until the clip arm hilt rests upon and is supported by said neck tie segment top edge;

e) suspending the napkin over the wearer's front by inserting the napkin between the clamp jaws, and f) closing the clamp jaws, thereby holding the napkin with the clamp.

* * * * *